United States Patent [19]

Rubertus

[11] 4,155,199

[45] May 22, 1979

[54] LOCKABLE GATE MECHANISM WITH AUTOMATIC REINDEXING FEATURE

[75] Inventor: Roland W. Rubertus, New Brighton, Minn.

[73] Assignee: Minnesota Mining and Manufacturing Company, Saint Paul, Minn.

[21] Appl. No.: 895,448

[22] Filed: Apr. 11, 1978

[51] Int. Cl.[2] ..... E06B 11/08

[52] U.S. Cl. ..... 49/141; 49/49

[58] Field of Search ..... 49/46, 47, 49, 141

[56] References Cited

U.S. PATENT DOCUMENTS

| | | | |
|---|---|---|---|
| 2,657,486 | 11/1953 | Sweetser | 49/49 X |
| 3,795,075 | 3/1974 | Orzechowski | 49/46 |
| 3,978,613 | 9/1976 | Hayward et al. | 49/46 |

*Primary Examiner*—Philip C. Kannan

*Attorney, Agent, or Firm*—Cruzan Alexander; Donald M. Sell; William B. Barte

[57] ABSTRACT

A gate for controllably inhibiting passage through a controlled zone which includes a rotating arm, the rotation of which may be prevented by a solenoid-coupled pawl which engages a gear-like multiposition detent member coupled to a shaft on which the arm is mounted. In the event excessive force is applied to the arm when thus locked to enable emergency egress, a clutch allows rotation of the shaft, and of the arm, with respect to the detent member. The arm may be automatically repositioned to enable a new position about the periphery of the detent member to become engageable by the pawl.

8 Claims, 3 Drawing Figures

LOCKABLE GATE MECHANISM WITH AUTOMATIC REINDEXING FEATURE

BACKGROUND OF THE INVENTION (1) Field of the Invention

This invention relates to turnstiles, gates and the like, such as are particularly designed for controlling pedestrian passage through a controlled zone, and in particular, to such devices as incorporate a remotely controllable locking means to bar such passage.

(2) Description of the Prior Art

Turnstiles, gates and like devices are commonly used to control passage, either into or out of a controlled zone. For example, such gates are frequently encountered at the entrance to subways, theaters, amusement parks and the like. More recently, such devices have also been utilized in conjunction with antipilferage systems at the exits of libraries, etc., to prevent the passage of persons upon the detection of an antipilferage marker.

Due to fire and safety concerns, such gates, particularly when positioned as a barrier to an exitway, are desirably provided with means such that locking mechanisms in the gates may be overcome in case of emergency. Typically, prior art gates have been provided with shear pins which couple the pivoting portions of the gate to the locking mechanism. Upon application of an excessive force, the shear pins may then be severed, allowing the gate to be opened. Such shear pins are undesirable in that they require manual servicing of the gate to replace the pins after such an event. Other prior art gates have avoided the use of shear pins by providing a friction coupling between the pivoting members and a member being selectively locked. Such gates are also undesirable in that manual servicing is still required to reindex the pivoting members at the closed position with respect to the locking mechanism.

SUMMARY OF THE INVENTION

In the present invention, a lockable gate for inhibiting passage through a controlled zone is provided in which the need for replacement of shear pins or manual repositioning of various members after emergency egress through an otherwise locked gate is eliminated. The gate of the present invention allows passage even though the gate is locked, by the application of an excessive force to a barrier member included in the gate, such as an arm or turnstile bar, which overcomes a locking mechanism included in the gate. The need for shear pins is eliminated by a clutch mechanism which slips upon application of an excessive force to allow the barrier member to move and which interacts with the locking mechanism to allow the arm to be automatically reindexed at the closed position with respect to the locking mechanism.

The present invention includes a support means adapted to be secured to a base proximate a controlled zone. Such a support means may be desirably directly secured to a floor. In the event a given floor is of concrete or the like, such that it is not possible or desirable to mechanically secure the support means to the floor, the support means may be secured to a base plate positioned such that persons passing through the gate must walk thereover, thus anchoring the gate in position.

A passage blocking member, such as a gate arm, is secured to a shaft which is in turn pivotally mounted on the support means to allow at least a partial rotation of the shaft about an axis to move the blocking member from a first angular position at which the member inhibits passage through the zone to another angular position allowing passage through the zone. A biasing means is also preferably included for automatically maintaining or returning the shaft to the first angular position.

A locking mechanism positioned within the support means enables the shaft to be controllably locked in the first angular position to thus prevent movement of the barrier member extending across the zone. This mechanism includes a rotatable multiposition detent member coupled to the shaft and a pawl controllably movable to engage and lock the detent member to prevent rotation thereof, thereby locking the shaft at the first angular position.

A clutch mechanism coupled to the shaft enables the shaft to be rotated with respect to the detent member when locked by the pawl to another angular position by the application of a force to the shaft in excess of that required to cause the clutch mechanism to slip.

Accordingly, the present invention provides for emergency passage through the gate by enabling the barrier member and thus the shaft to be forcibly rotated with respect to a locked detent member such that the clutch is caused to slip. This slippage results in the shaft assuming a new angular relationship with respect to the detent mechanism, while retaining the same angular relationship with respect to the support means and hence to the passageway. When the shaft is rotated back to its first angular position, such as by the biasing means, a new position of the multiposition detent member becomes engageable by the pawl.

An additional advantage of the multiposition detent member is that it enables locking the barrier member and hence the shaft, at a variety of positions in addition to that at which the barrier member is directly extending across the passageway. Thus, for example, the barrier member may be moved from its first angular position, or home position, to a partially open position and be locked in the partially open position to still inhibit passage. In contrast, prior art devices are typically lockable only in the home position.

DESCRIPTION OF THE PREFERRED EMBODIMENTS

Figure 1:
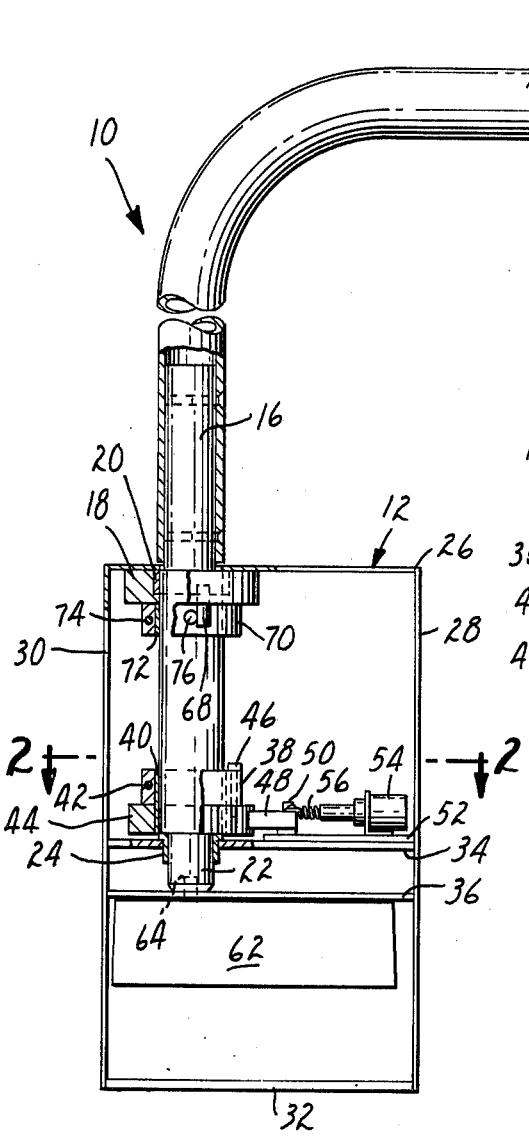
FIG. 1 is a side elevation of the gate according to one embodiment of the present invention with some parts thereof broken away.

As shown in FIG. 1, in a preferred embodiment, the gate 10 of the present invention comprises a support member such as a housing 12 upon which a barrier member is pivotally mounted. The barrier member includes an arm 14 rigidly attached to a shaft 16, which in turn is pivotally mounted within the housing 12 by means of appropriately positioned bushings. A collar 18 is affixed to the upper portion of the housing 12, and contains a bronze bushing 20 for supporting the upper portion of the shaft 16. Similarly, the lower portion 22 of the shaft 16 is pivotally mounted within a bushing member 24.

The housing 12 is of conventional construction and preferably is formed of a 0.104 thick (12 gauge) steel plate bent to provide the top and side walls 26, 28 and 30, and rear panel (not shown) respectively. A base member 32 and inner support members 34 and 36, which are also desirably formed of 0.104 (12 gauge) steel plate or thicker, are preferably welded to the side panels 28 and 30 in a conventional manner to provide a rigid assembly. If desired, a front panel (not shown) may then be added to the housing 12 by welding, screws or the like. In a preferable construction, the housing 12 is approximately 15 inches (38 cm) high and approximately 9.5 inches (24 cm) wide. The gate arm 14 desirably extends above the housing 12 approximately 20 inches (50 cm) and provides an extension approximately 36 inches (90 cm) long to extend across an adjacent passageway.

Figure 2:
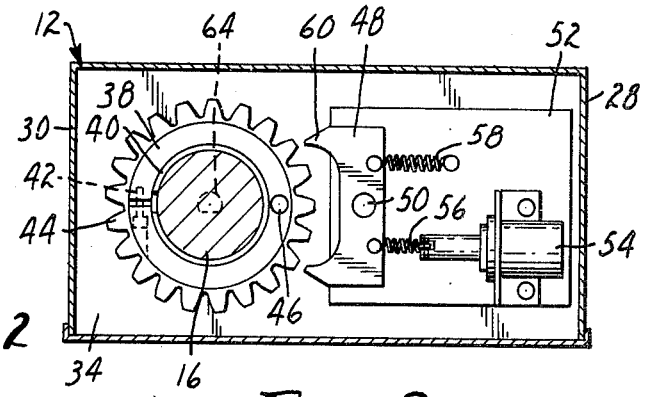
FIG. 2 is a cross sectional view of the gate shown in FIG. 1 taken along the line 2—2, when the locking mechanism is disengaged.
Figure 3:
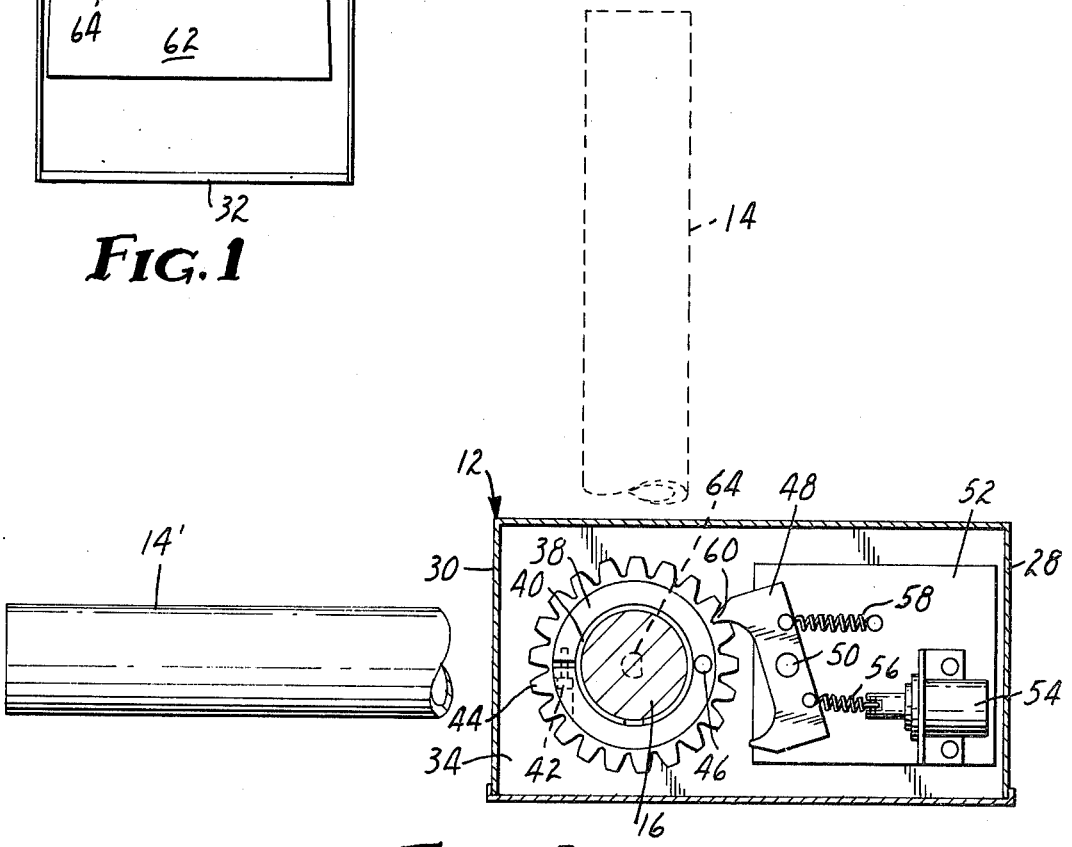
FIG. 3 is a cross sectional view, similar to that of FIG. 2, showing the locking mechanism in a locked position.

As shown in FIG. 1 and in further detail in FIGS. 2 and 3, a combined clutch and detent assembly is mounted on the shaft 16 such as to bear against the bushing 24. This assembly includes a slip collar 38 within which is mounted a band of resilient clutch material 40 such as formed of conventional brake lining composition. The collar 38 is slit and a set screw 42 is provided to enable the width of the slit to be adjusted, thereby controlling the minimum force at which the shaft 16 may be caused to rotate with respect to the collar 38. A detent member 44 such as a conventional spur gear having a center clearance hole allowing free rotation of the shaft 16 therewithin is secured to the slip collar 38 by means of a screw 46. The combined assembly comprising the slip collar 38 and the detent gear 44 are thus free to rotate along with the shaft 16 so long as the detent member 44 is unlocked. Should the member 44 be locked, excessive force applied to the shaft 16 will cause the resilient clutch material 40 to slip, allowing the shaft to rotate with respect to the collar 38.

Controllable locking of the detent member 44 is provided by a pawl 48 which is mounted by means of a pivot 50 on a base member 52, which is in turn secured to the inner support member 34. The pawl 48 is in turn coupled to a solenoid 54 on the support member 34 by means of a coupling spring 56, and to a return spring 58. The opposite end of the spring 58 is also secured to the base member 52.

As further shown in FIG. 1, a biasing mechanism 62 is mounted on the support member 36 within the support member 12 for automatically returning the shaft 16 to a first angular position, at which the arm 14 extends across a passageway. Such a biasing member preferably consists of a conventional hydraulic door closer mechanism having a spring loaded flattened shaft 64 which is inserted into a similarly shaped recess at the end of the lower portion 22 of the shaft 16.

The collar 18, within which the upper bushing 20 is supported, is preferably welded to the top wall 26, and preferably includes at least a pair of home stops, one of which 68 is shown in FIG. 1. An additional slip collar 70 which is preferably identical in construction to the slip collar 38 is secured to the shaft 16 just below the collar 18. The slip collar 70 further includes a band of resilient clutch material 72 therein. A gap through the slip collar 70 is adjustable by a set screw 74, for controlling the force required to allow slippage between the slip collar 70 and the shaft 16. The collar 70 is further provided with a projection 76 such as a screw head to bear against the home stops 68 and thereby prevent further rotation. Accordingly, when the arm 14 is in a first angular position at which the member extends across a passageway, the projecting pin 76 will bear against the stop 68, thereby preventing further rotation. A similar home stop (not shown) against which the pin 76 may bear when the arm 14 is in the open position is similarly provided. In the event excessive force is applied against the arm 14, rotation of the shaft beyond the home positions provided by the stops 68 is allowed by means of slippage of the shaft with respect to the collar 70. In the event of such an occurrence, however, the arm must be repositioned to the first angular position by rotating the arm in a counter direction until the pin 76 bears against the opposite home stop, and a similar force applied to cause reverse slippage of the shaft with respect to the slip collar 70.

The manner in which the arm 14 may be controllably locked to inhibit passage through a controlled zone, and by which automatic repositioning of the arm is effected subsequent emergency reopening of the arm 14, is further detailed in FIGS. 2 and 3. FIGS. 2 and 3 show a cross section taken along the lines 2—2 of FIG. 1. FIG. 2 shows a mode wherein the detent member 44, and hence also the collar 38 and shaft 16 are freely rotating, by virtue of the pawl 48 being withdrawn from the teeth about the periphery of the detent member 44. The member 44 may be a conventional 32 tooth or other dimensioned spur gear such as is commonly available, or may be formed of a laminate of a number of stamped sections. As is shown in FIG. 2, when the solenoid 54 is disengaged, the pawl is returned to a normal, disengaged position by the return spring 58, such that the detent member 44 is free to rotate.

Conversely, as shown in FIG. 3, when the solenoid 54 is energized, the pawl 48 is rotated about pivot 50 such that the upper projection 60 is caused to engage one of the teeth in the detent member 44. In the event excessive force is applied to the arm 14 when the projection 60 of the pawl 48 is engaged with the detent member 44, such that the arm is rotated around the position 14', the shaft 16 will be caused to slip with respect to the slip collar 38 such that the relative position of the shaft 16 with respect to the assembly of the detent member 44 and slip collar 38 is changed. When the force against the arm 14 is removed, the biasing mechansim 62 will tend to cause a reverse rotation of the shaft 16 so as to return the arm 14 to its original position. When the solenoid is thereafter released, the return spring 58 causes the pawl 48 to return to the position shown in FIG. 2. This, in turn allows the reverse rotation of the shaft 16 such that a new position on the periphery of the detent member 44 will thus be engageable by the upper projection 60 of the pawl 48.

In a preferred embodiment, the gate of the present invention is adapted to be readily modified to enable either clockwise or counter-clockwise rotation of the shaft 16 and arm 14. In such an embodiment, the solenoid 54 is adapted to be repositioned and coupled to the spring 58 so as to act on the upper portion 60 of the pawl 48 while the spring 56 is then secured to the base member 52. Similarly, in such an embodiment, the collar 18 is desirably provided with a plurality of recesses within which screws may be positioned to provide limiting of the desired degree of rotation. In a further embodiment, where such a gate is desirably used to bear all but emergency egress, such pins may be positioned on the collar 18 so as to sandwich the projecting pin 76 closely therebetween, thereby preventing all motion of the barrier member 14 except when excessive force is applied, so as to cause slippage via the clutch material 72.

The gate of the present invention is particularly desirably used in conjunction with antipilferage systems such as may utilize coils for generating a magnetic field within a corridor. Such coils are typically positioned on both sides of the corridor and may be provided with a base plate supporting the opposing coil assemblies. In such an application, the base member 32 of the housing 12 may be secured directly to such a base plate. Alternatively, the base member 32 may be secured directly to floors as desired. The solenoid 54 thus provides a desirable means for inhibiting passage through a controlled zone, such as in the event the presence of an antipilferage marker is detected and an alarm signal is generated, which signal is caused to energize the solenoid 54 to lock the arm 14. In alternative embodiments, other means such as a mechanical linkage may be similarly provided to actuate the pawl 48.

Likewise, a variety of alternative clutch and detent assemblies may similarly be provided within the scope of the present invention. For example, while a common assembly of a clutch member and detent member surrounding a rotatable shaft 16 is desired due to the simplicity of construction, a similar construction, wherein the detent member is separately mounted on an idler shaft, may similarly be employed.

Having thus described the present invention, what is claimed is:

1. A gate for inhibiting passage through a controlled zone, comprising (a) support means adapted to be secured to a base proximate said controlled zone, (b) barrier means including a passage blocking member secured to a shaft pivotally mounted on said support means, (c) locking means positioned within said support means for controllably locking said shaft in a first angular position at which said blocking member inhibits passage through said zone, including a rotatable multiposition detent member coupled to said shaft, a pawl for engaging and locking the detent member for preventing rotation thereof and hence of said shaft and passage blocking member, and means for controllably moving said pawl to a locked or unlocked position, (d) means for biasing said shaft to said first angular position, and (e) clutch means coupled to said shaft for enabling rotation of said shaft from said first angular position by the application of an angular force to said shaft causing slipping of said clutch means, whereby emergency passage through said zone is permitted by forcible rotation of the shaft to a different angular position with respect to said detent member when locked by said pawl such that said passage blocking member is moved to permit passage thereby, and when said shaft is returned to said first angular position at which said blocking member inhibits passage, a different one of said multipositions of the detent member may be engaged by the pawl.

2. A gate according to claim 1, wherein said support means includes a collar positioned to support said shaft for rotation therein, which collar includes a plurality of apertures adapted to receive at least one projecting member against which a mating projection on said shaft may bear, thus inhibiting rotation of said shaft beyond said projecting member.

3. A gate according to claim 2, wherein said barrier means includes a collar secured to said shaft and having secured thereto said mating projection, said collar including a resilient lining allowing slippage of said collar when said passage blocking member is forced, causing said shaft to be rotated past an angular position defined by said mating projecting members bearing on each other.

4. A gate according to claim 1, wherein said biasing means includes a hydraulically damped member for controllably returning said shaft to said first angular position.

5. A gate according to claim 1, wherein said clutch means comprises a collar surrounding said shaft and having a resilient inner surface in contact therewithin, the outer surface thereof being in contact with said detent member.

6. A gate according to claim 5, wherein said detent means comprises a gear-like member coaxially mounted on said shaft and having said collar between the inner bore thereof and said shaft and means for adjusting the clearance between said inner bore and said collar to thereby control the force required to cause slippage of the clutch means.

7. A gate according to claim 1, wherein said locking means comprises a solenoid coupled to said pawl which when energized causes the pawl to engage the detent member and a return spring for disengaging the pawl when the solenoid is disengaged.

8. A gate according to claim 7, wherein said pawl includes an elongated member having portions adapted to engage said detent member oppositely positioned about a central pivot, said solenoid being further adapted to be coupled to cause said pawl to pivot to engage either of said engagement portions, thereby selectively preventing rotation of said shaft in either a clockwise or counter-clockwise direction.

* * * * *